US005832668A

United States Patent [19]

Faubert et al.

[11] Patent Number: 5,832,668

[45] Date of Patent: Nov. 10, 1998

[54] VEHICLE SLIDING DOOR MODULAR GLIDE SYSTEM

[75] Inventors: Robert J. Faubert, Rochester Hills; Waine T. Brock, Troy; Terence W. Haskin, Lapeer, all of Mich.

[73] Assignee: Chrysler Corporation, Auburn Hills, Mich.

[21] Appl. No.: 867,593

[22] Filed: Jun. 2, 1997

[51] Int. Cl.[6] ..... E05D 15/10

[52] U.S. Cl. ..... 49/215; 49/213; 49/209; 16/88

[58] Field of Search ..... 49/209, 211, 213, 49/214, 215, 216, 221, 409, 410; 16/88, 97, 106

[56] References Cited

U.S. PATENT DOCUMENTS

| | | | |
|---|---|---|---|
| 3,143,758 | 8/1964 | Dunham | 16/88 |
| 4,080,686 | 3/1978 | Hagen | 16/88 |
| 4,112,539 | 9/1978 | Hagen | 16/88 |
| 4,152,872 | 5/1979 | Tanizaki et al. | 49/215 X |
| 4,869,544 | 9/1989 | Anwyll et al. | 49/221 X |

*Primary Examiner*—Jerry Redman
*Attorney, Agent, or Firm*—Thomas G. Pasternak

[57] ABSTRACT

A guide assembly for a motor vehicle having a sliding door includes a track having longitudinally extending grooves in opposite surfaces thereof and disposed horizontally on the vehicle. The guide assembly also includes a support bracket having one end connected with the sliding door and another end including a bearing housing. The bearing housing has a longitudinal slot including sides having spacedly opposed bearing pockets. A plurality of ball bearings is rotatably mounted in the opposed bearing pockets and engages the longitudinally extending grooves in the opposite surfaces of the track for supporting and guiding the support bracket and sliding door for movement relative to the vehicle.

16 Claims, 3 Drawing Sheets

VEHICLE SLIDING DOOR MODULAR GLIDE SYSTEM

FIELD OF THE INVENTION

This invention relates to a van type vehicle sliding door assembly and more particularly to a track and bearing assembly to allow for improved movement of a sliding door between a first position wherein the door is suspended parallel to and adjacent a side of the vehicle and a second position wherein the door closes an opening in the vehicle side and lies flush with the vehicle side.

BACKGROUND OF THE INVENTION

It is known in the art relating to van type vehicles having sliding door assemblies to utilize a guide means connected to a linkage mounted on the door to allow the door to be displaced along guide tracks situated on the vehicle. Typically, conventional guide means include two guide rollers rotatably mounted about a vertical axis of rotation and a support roller rotatably mounted about a horizontal axis. These rollers engage a track disposed horizontally along the vehicle and allow the door to be slid between open and closed positions as is well known.

It is also known that the track is required to be curved inwardly toward the vehicle center along its terminus to allow the door to be closed as the guide means follows the track to cause the trailing edge of the door to sealingly engage the corresponding edge of the opening. In use, the guide and support rollers are small in diameter to allow the rollers to negotiate the curve in the track. These rollers rotate on a large number of small bearings. Such a guide means requires significant in plant handling during installation and relies on the precision of the guide and support rollers for independent door guidance and door support.

SUMMARY OF THE INVENTION

The present invention provides a vehicle sliding door modular glide system that combines the guidance and support characteristics of the prior art independent guide and support rollers to provide an improved guide means that is simpler in construction, more durable in use and easier to install and maintain.

In carrying out the invention the guide means includes a track disposed horizontally on the side of the vehicle. The track includes longitudinally extending grooves in opposite surfaces of the track. The guide means also includes a support bracket having one end connected with the sliding door and another end including a bearing housing. The end connected to the sliding door may be one portion of a hinge that mounts the door on the vehicle. The bearing housing defines a longitudinal slot and includes sides having spacedly opposed bearing pockets.

A plurality of ball bearings is rotatably mounted in the opposed bearing pockets and the ball bearings engage the longitudinally extending grooves in the opposite surfaces of the track. The support bracket supports and guides the sliding door for movement relative to the vehicle. The opposed bearing pockets each comprise a closed end groove for containing the plurality of bearings.

In a preferred arrangement the opposed bearing pockets are made of plastic material or have a plastic liner such as urethane that acts as a lubricant and reduces any bearing noise.

Advantageously, three separate tracks are spacedly mounted on the vehicle and three corresponding supports are mounted on the vehicle door to form a modular glide system whereby the sliding door is moveable between a first position wherein the sliding door is held suspended parallel to and adjacent the side of the vehicle and a second position wherein the sliding door closes an opening in the vehicle side.

These and other features and advantages of the invention will be more fully understood from the following detailed description of the invention taken together with the accompanying drawings.

DETAILED DESCRIPTION OF THE INVENTION

Figure 1:
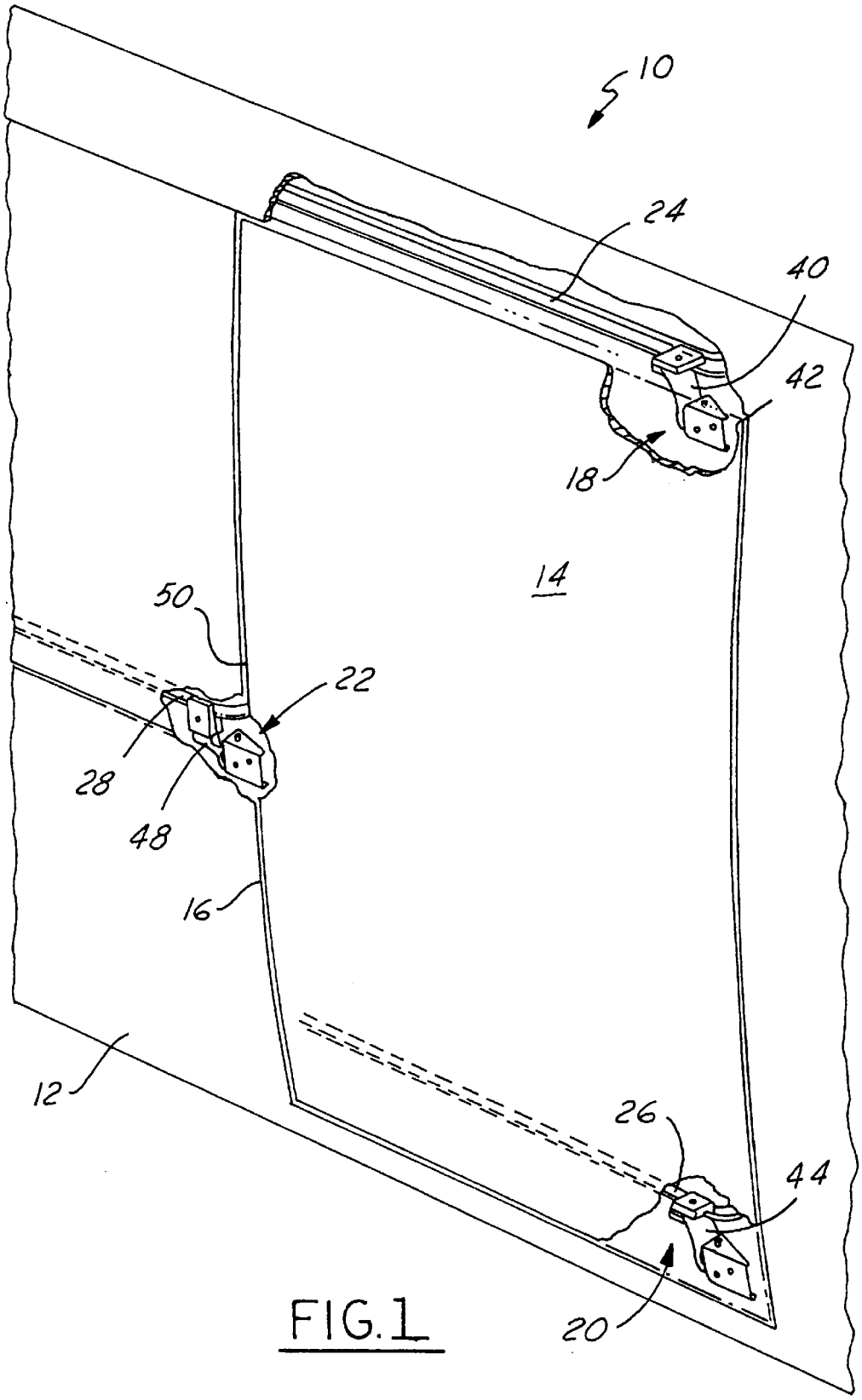
FIG. 1 is a partial side view, with parts broken away, of a van type vehicle having a sliding door assembly according to the invention.

Referring now to the drawings in detail, there is shown in FIG. 1, a side 12 of a van 10 having a sliding door assembly 14 for closing an opening 16 in the side as is known. As is hereinafter more fully described, a guide means includes opposed ball bearings that engage opposite sides of a track to provide combined guidance and support of the sliding door assembly 14.

With continuing reference to FIG. 1, upper 18, lower 20, and intermediate 22 guide means are provided for the sliding door 14. Each of the guide means 18,20,22 includes a respective track 24,26,28 disposed horizontally on the vehicle 10. Each track 24,26,28 includes longitudinally extending grooves 30,32 (FIGS. 2 and 3) having a generally U-shaped cross section in opposite surfaces 34,36 of the track. Tracks 24 and 28 are representative of the invention and illustrated in FIGS. 2 and 3.

Each of the guide means 18,20,22 also includes a support bracket having one end connected with the sliding door 14, through hinge means, as are known. A first support bracket 40 is mounted generally adjacent the upper leading edge 42 of the sliding door 14, a second support bracket 44 is mounted generally adjacent the lower leading edge 46 of said sliding door, and a third support bracket 48 is mounted generally adjacent the trailing edge 50 of the door intermediate the door upper and lower edges.

Figure 2:
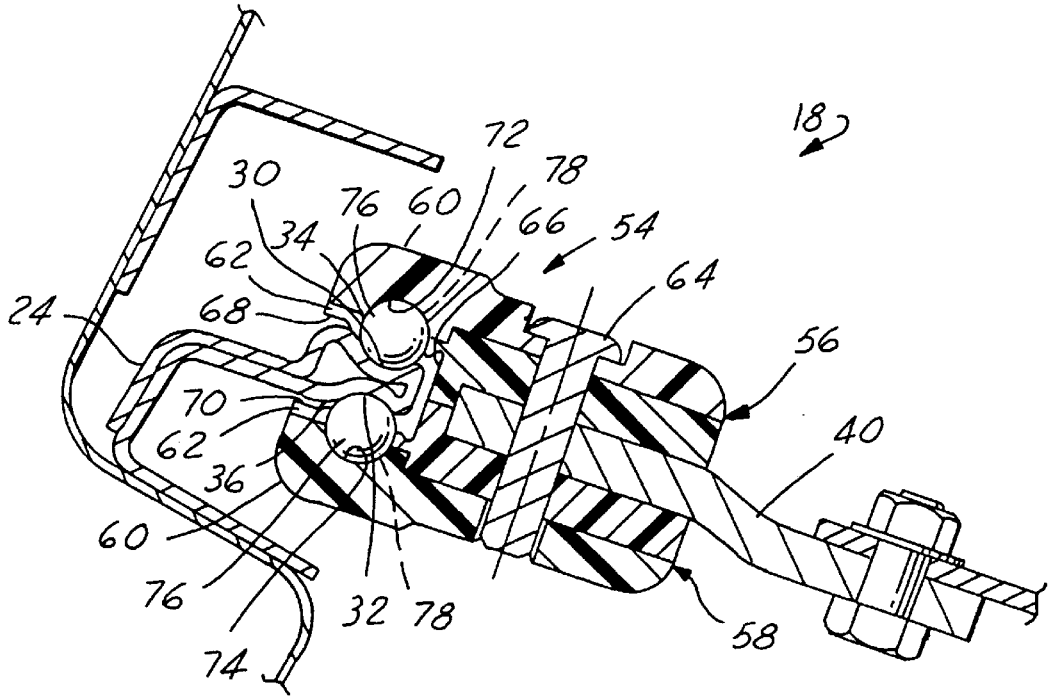
FIG. 2 is a detailed sectional view of a portion of FIG. 1 illustrating a track and bearing assembly.
Figure 4:
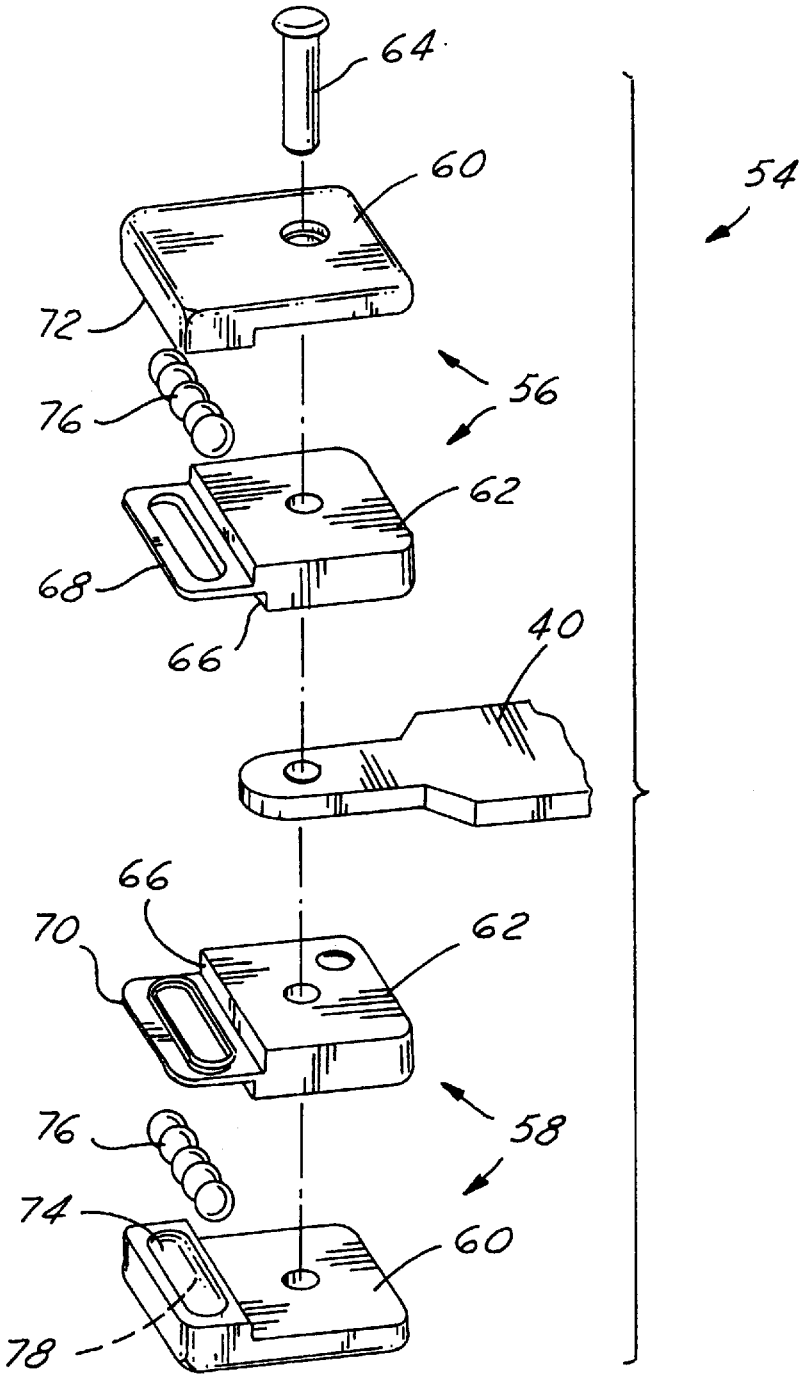
FIG. 4 is an exploded view of the bearing assembly of the invention illustrating a closed end groove for containing a plurality of bearings.

The other end of the each support bracket 40,44,48 includes a bearing housing such as housing 54, shown in FIG. 2 and in exploded detail in FIG. 4. The bearing housing 54 includes first and second bearing mountings 56,58. Each bearing mounting 56,58 defines one half of the bearing housing 54 and includes a ball pocket portion 60 and a ball retainer portion 62. When assembled to support bracket 40, by a fastening means such as pin 64, the bearing housing 54 defines a longitudinal slot 66 that includes sides 68,70 having spacedly opposed bearing pockets 72,74. Each bearing pocket 72,74 comprises a closed end groove which may mount one or a plurality of ball bearings 76. Preferably, the opposed bearing pockets 72,74 are made of plastic material and/or include a lubricant means such as a urethane liner 78 to reduce friction and bearing noise.

Figure 3:
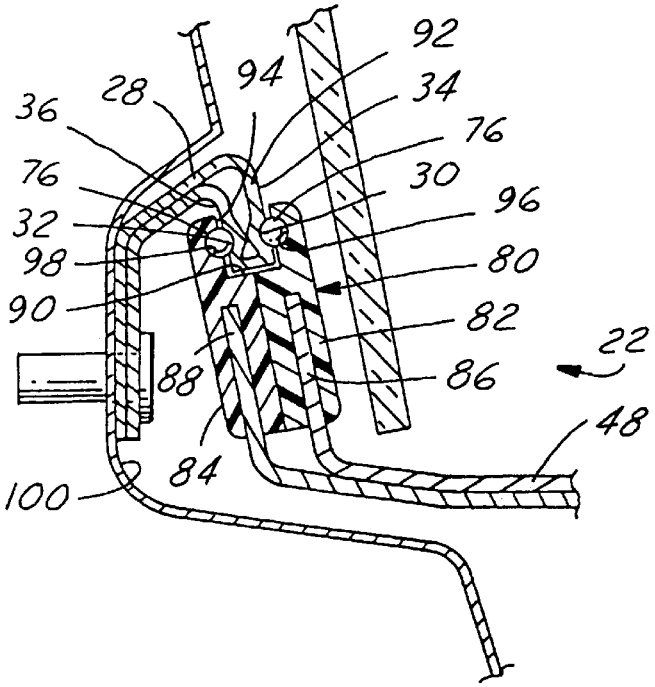
FIG. 3 is a detailed sectional view of another portion of FIG. 1 illustrating another track and bearing assembly.

FIG. 3 illustrates the arrangement of the center bracket 48 and track 28 interconnected by an alternative embodiment of bearing housing 80. Housing 80 includes first and second bearing mountings 82,84 which are integral members as opposed to the two-piece mountings 56,58 of bearing housing 54 in FIGS. 2 and 4. Mountings 82,84 are individually fixed to spaced ends 86,88 of the support bracket 48 and are secured together to form the bearing housing 80. A slot 90 is formed in the outer edge of the housing 80 and includes sides 92,94 between which the grooved portion of the track 28 is received. Spacedly opposed bearing pockets 96,98 are formed in sides 92,94 and comprise closed end grooves each of which may mount one or a plurality of ball bearings 76. The bearing pockets 96,98 and associated mounting members 82,84 may be made of plastic to reduce friction and noise. In the arrangement shown, the track 28 is mounted in a recess 100 of the van side 12 and is hidden behind a dark glass window panel 102.

A plurality of ball bearings 76 is rotatably mounted in the opposed bearing pockets 72,74,96,98 including at least one, and preferably more than one, ball bearing in each pocket. The ball bearings 76 engage the longitudinally extending grooves 30,32 in the opposite surfaces 34,36 of each track 24,26,28 thereby mounting and supporting each bracket 40,44,48 on the respective track. Such support is provided regardless of the angular orientation of the grooves 30,32 relative to the vehicle as the bearings engage the track therebetween as illustrated in FIGS. 2 and 3 of the drawings.

In the embodiment illustrated, the sliding door 14 is movably guided on the three parallel tracks 24,26,28 between a first position wherein the sliding door is held suspended parallel to and adjacent a side of the vehicle and a second position, illustrated in FIG. 1 wherein the sliding door closes opening 16 in the vehicle side 12.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A guide means for a motor vehicle having a sliding door, said guide means comprising:

a track adapted to be disposed horizontally on said vehicle; said track including longitudinally extending grooves in opposite surfaces thereof;

a support bracket having one end connected with said sliding door and another end including a bearing housing; said bearing housing defining a longitudinal slot including sides having spacedly opposed bearing pockets; and a plurality of ball bearings rotatably mounted in said opposed bearing pockets; said ball bearings engaging said longitudinally extending grooves in the opposite surfaces of said track for supporting and guiding said support bracket and said sliding door for movement relative to said vehicle.

2. The guide means of claim 1 wherein said opposed bearing pockets each comprise a closed end groove for containing said plurality of bearings.

3. The guide means of claim 1 wherein said opposed bearing pockets are made of plastic material.

4. The guide means of claim 1 wherein said bearing housing includes a urethane insert in contact with said ball bearings.

5. A sliding door modular glide system for a motor vehicle having a sliding door comprising:

three separate guide means for said sliding door, said sliding door being moveable on said three guide means between a first position wherein said sliding door is held suspended parallel to and adjacent a side of said vehicle and a second position wherein said sliding door closes an opening in said vehicle side; the first of said guide means being mounted adjacent an upper leading edge of the sliding door, the second of said guide means being mounted adjacent a lower leading edge of said sliding door, and the third of said guide means being mounted adjacent a trailing edge of said door intermediate said upper and lower edges thereof; each of said guide means comprising:

a track adapted to be disposed horizontally on said vehicle; said track including longitudinally extending grooves in opposite surfaces thereof;

a support bracket having one end connected with said sliding door and another end including a bearing housing; said bearing housing defining a longitudinal slot including sides having spacedly opposed bearing pockets; and a plurality of ball rotatably mounted in said opposed bearing pockets; said ball bearings engaging said longitudinally extending grooves in the opposite surface of said track for supporting and guiding said support bracket and said sliding door for movement between said first and second positions.

6. The guide means of claim 5 wherein said opposed bearing pockets each comprise a closed end groove for containing a plurality of bearings.

7. The guide means of claim 5 wherein said opposed bearing pockets are made of plastic material.

8. The guide means of claim 5 wherein said bearing housing includes a urethane insert in contact with said ball bearings.

9. A vehicle comprising:

a body defining a door opening;

a sliding door moveable between a first position wherein said sliding door is held suspended parallel to and adjacent a side of the motor vehicle and a second position wherein said sliding door closes the door opening; and a mounting arrangement slidably interconnecting said sliding door and said body, said guide arrangement including at least one guide assembly, each guide assembly including:

a track disposed horizontally on said body, said track including longitudinally extending grooves in opposite surfaces thereof;

a support bracket having one end connected with said sliding door and another end including a bearing housing, said bearing housing defining a longitudinal slot including sides having spacedly opposed bearing pockets; and a plurality of ball bearings rotatably mounted in said opposed bearing pockets, said ball bearings engaging said longitudinally extending grooves in the opposite surfaces of said track for supporting and guiding said support bracket and said sliding door for movement relative to said body.

10. The motor vehicle of claim 9, wherein said at least one guide assembly comprises three guide assemblies.

11. The motor vehicle of claim 10, wherein a first guide assembly is mounted adjacent an upper leading edge of said sliding door.

12. The motor vehicle of claim 11, wherein said a second guide assembly is mounted adjacent a lower leading edge of said sliding door.

13. The motor vehicle of claim 12, wherein said a third guide assembly is mounted adjacent a trailing edge of said sliding door intermediate said upper and lower leading edges thereof.

14. The motor vehicle of claim 9, wherein said opposed bearing pockets of each of said at least one guide assembly includes a closed end groove for containing a plurality of bearings.

15. The motor vehicle of claim 9, wherein said opposed bearing pockets of each of said at least one guide assembly are made of plastic material.

16. The motor vehicle of claim 9, wherein said bearing housing of each of said at least one guide assembly includes a urethane insert in contact with said ball bearings.

* * * * *